US011575222B2

(12) United States Patent
Chen

(10) Patent No.: US 11,575,222 B2
(45) Date of Patent: Feb. 7, 2023

(54) SOCKET STRUCTURE

(71) Applicant: Delta Electronics, Inc., Taoyuan (TW)

(72) Inventor: Wei-Yao Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/318,575

(22) Filed: May 12, 2021

(65) Prior Publication Data

US 2022/0131291 A1 Apr. 28, 2022

(30) Foreign Application Priority Data

Oct. 23, 2020 (CN) ..... 202011150313.7

(51) Int. Cl.
*H01R 12/00* (2006.01)
*H01R 12/70* (2011.01)
*H01R 12/71* (2011.01)

(52) U.S. Cl.
CPC ..... *H01R 12/707* (2013.01); *H01R 12/716* (2013.01)

(58) Field of Classification Search
CPC H01R 12/707; H01R 12/716; H01R 12/7052; H01R 2103/00; H01R 12/58; H01R 12/722; H01R 24/78; H01R 12/7088
See application file for complete search history.

(56) References Cited

U.S. PATENT DOCUMENTS 4,845,592 A * 7/1989 Himes, Jr. ..... H02G 5/005 361/776
5,080,609 A * 1/1992 Fabian ..... H01R 12/7082 439/541.5
5,145,384 A 9/1992 Asakawa et al.
5,415,568 A * 5/1995 Kinoshita ..... H01R 43/16 439/98
6,062,872 A * 5/2000 Strange ..... H01R 12/52 439/247
6,126,457 A * 10/2000 Smith ..... B60R 16/0238 439/949

(Continued)

FOREIGN PATENT DOCUMENTS

CN 104979684 B 1/2019
TW I260120 B 8/2006
TW M406837 U 7/2011

*Primary Examiner* — Abdullah A Riyami
*Assistant Examiner* — Nelson R. Burgos-Guntin
(74) *Attorney, Agent, or Firm* — Kirton McConkie; Evan R. Witt

(57) ABSTRACT

A socket structure is provided and includes a circuit board, an insulating base, a pin and a conductive component. The insulating base is disposed on the circuit board and includes a first side and a second side opposite to each other. The pin is disposed between the first side and the second side. The conductive component is connected between the circuit board and the insulating base and includes a first arm, a second arm and a connecting part. The first arm and the second arm are connected to each other through the connecting part. The first arm is fixed on the second side of the insulating base and connected to the pin and includes a first fixing end connected to the circuit board. The second arm includes a second fixing end connected to the circuit board.

20 Claims, 15 Drawing Sheets

(56) References Cited

U.S. PATENT DOCUMENTS

| | | | | |
|---|---|---|---|---|
| 7,959,445 | B1 * | 6/2011 | Daily | H01R 12/716 439/928 |
| 8,040,688 | B2 * | 10/2011 | Tatsukami | G06F 1/1616 361/810 |
| 8,057,266 | B1 * | 11/2011 | Roitberg | H01R 13/055 439/907 |
| 8,328,571 | B2 * | 12/2012 | Mulfinger | G06F 1/185 439/260 |
| 8,449,321 | B2 * | 5/2013 | Raybold | H01R 12/7088 439/540.1 |
| 8,840,415 | B2 * | 9/2014 | Orris | H01R 13/025 439/495 |
| 9,837,773 | B2 * | 12/2017 | Sumskas | H01R 43/24 |
| 10,193,256 | B1 * | 1/2019 | Chen | H01R 13/055 |
| 10,893,615 | B2 * | 1/2021 | Rietsch | H05K 3/366 |
| 2005/0112919 | A1 | 5/2005 | Lee | |
| 2008/0227314 | A1 * | 9/2008 | Taylor | H05K 1/118 439/78 |
| 2012/0142227 | A1 * | 6/2012 | Yu | H01R 12/712 439/695 |
| 2012/0208379 | A1 | 8/2012 | Lai | |
| 2012/0329294 | A1 * | 12/2012 | Raybold | H01R 12/7088 439/55 |
| 2013/0089997 | A1 * | 4/2013 | Orris | H01R 13/6272 439/492 |

* cited by examiner

SOCKET STRUCTURE

FIELD OF THE INVENTION

The present disclosure relates to an electrical connector, and more particularly to a socket structure capable of eliminating the internal stress applied thereto and ensuring the stability of the electrical connection thereof.

BACKGROUND OF THE INVENTION

With the rapid development of science and technology today, sockets are now widely used in various electronic devices in life. Different from other internal components, the socket served as a power input medium is directly influenced by the external environment. Therefore, the durability of the socket is the key to the long-term stable operation of electronic equipment.

FIG. 1 is a schematic perspective view illustrating a conventional socket structure. The conventional socket structure 9 includes a circuit board 91, an insulating base 92, a pin (not shown), a conductive component 94 and an auxiliary conductive component 95. The pin is disposed within the insulating base 92. The conductive component 94 is disposed on a side of the insulating base 92. An end of the conductive component 94 is fixed to an end of the pin by riveting. The conductive component 94 includes a fixing end (not shown) fixed to the circuit board 91 by welding for providing an electrically conductive medium.

Since the conductive component 94 of the conventional socket structure 9 is welded to the circuit board 91 only through a single fixing end, it lacks sufficient strength to resist stress caused by plugging and unplugging frequently. Therefore, the welding joints connecting the socket and the circuit board 91 are easily being cracked or even separated. When the electronic equipment is operated under the situation of welding joints cracked continuously, the resistance of the welding joints is increased. Moreover, temperature of the welding joints is increased accordingly when the current passes therethrough. It results in damaging the internal components or reducing the lifespan, and even a risk of causing a fire.

Therefore, there is a need of providing a socket structure capable of eliminating the internal stress applied thereto and ensuring the stability of the electrical connection thereof.

SUMMARY OF THE INVENTION

An object of the present disclosure is to provide a socket structure. With design of a conductive component, an internal stress applied to the socket structure is eliminated, and the stability of the electrical connection is ensured. The conductive component disposed on a circuit board further includes two arms connected to each other through a connecting part. When the socket structure and a corresponding plug are plugged and unplugged frequently, the two arms and the connecting part of the conductive component are capable of resisting the force applied to the conductive component by deformation. It is helpful for eliminating the internal stress applied to a connection such as a welding joint between the conductive component and the circuit board, so as to avoid the risk of failure due to long-term and frequent plugging and unplugging. Moreover, the entire structure is enhanced, and the stability of the electrical connection is ensured.

Another object of the present disclosure is to provide a socket structure. A connection between a conductive component and a circuit board is further implemented by two fixing ends. When the socket structure and a corresponding plug are plugged and unplugged, an extra support point is provided by the two fixing ends. It is helpful for eliminating the internal stress applied to the welding joint connection between the conductive component and the circuit board, so as to avoid the risk of failure due to long-term and frequent plugging and unplugging. Consequently, the entire structure is enhanced, and the stability of the electrical connection is ensured.

A further object of the present disclosure is to provide a socket structure. The connection of a pin and a circuit board is implemented through a conductive component. In addition to being an electrically conductive medium, the conductive component is capable of resisting the force of plugging and unplugging by deformation. With an U-shaped and wavy structural design and the misaligned connecting positions of the two arms, the entire structure is further enhanced. Moreover, the conductive component passes through and is welded to the circuit board by utilizing the two arms, and an extra supporting point is provided. Since the two arms are at the same potential, when one of the two arms fails, the normal function of the conductive component is maintained by the other one of the two arms. Therefore, with the design of the conductive component of the present disclosure, it is helpful for enhancing the socket structure. The problems of increasing the resistance and the temperature due to the separated or cracked welding joint are avoided. In addition, the risks of damaging the internal components, reducing the lifespan and causing a fire are reduced. Thus, the purposes of improving the stability and the reliability of the socket structure are achieved.

In accordance with an aspect of the present disclosure, there is provided a socket structure including a circuit board, an insulating base, a pin and a conductive component. The insulating base is disposed on the circuit board and includes a first side and a second side opposite to each other. The pin is disposed between the first side and the second side. The conductive component is connected between the circuit board and the insulating base and includes a first arm, a second arm and a connecting part. The first arm and the second arm are connected to each other through the connecting part. The first arm is fixed on the second side of the insulating base, connected to the pin and includes a first fixing end connected to the circuit board. The second arm includes a second fixing end connected to the circuit board.

In an embodiment, the first fixing end and the second fixing end pass through the circuit board, respectively.

In an embodiment, the first fixing end and the second fixing end are connected to the circuit board through two individual welding joints, respectively.

In an embodiment, the socket structure includes a first direction, which is a direction from the first side to the second side.

In an embodiment, the socket structure is configured to be detachably connected with a plug. The plug passes through the first side of the insulation base along the first direction and is electrically connected to the pin.

In an embodiment, the first fixing end and the second fixing end are spaced apart from each other and disposed on the circuit board along the first direction.

In an embodiment, the first fixing end and the second fixing end have a separation distance ranged from 3 mm to 50 mm along the first direction, so as to facilitate the first fixing end and the second fixing end being connected to the circuit board through two individual welding joints, respectively.

In an embodiment, the first fixing end and the second fixing end are misaligned to each other along the first direction.

In an embodiment, the second arm includes a bended portion. The bended portion and the end of the pin are misaligned to each other along the first direction, so as to facilitate the first arm being connected to the pin.

In an embodiment, the pin is a male pin or a female pin.

In an embodiment, the first arm, the second arm and the connecting part collaboratively form an U-shaped structure.

In an embodiment, the first arm is connected to an end of the pin by riveting.

In an embodiment, the first arm includes a convex portion connected to an end of the pin.

In an embodiment, the second arm includes a wavy portion disposed between the connecting part and the second fixing end.

In an embodiment, the insulating base further includes an accommodating groove adjacent to an end of the pin. The first arm of the conductive component is embedded in the accommodating groove and connected to the end of the pin, so as to reduce volume of the insulating base.

In an embodiment, the insulating base further includes a positioning column disposed on a third side and passing through the circuit board, so as to facilitate the conductive component being welded to the circuit board. The third side is connected between the first side and the second side.

In an embodiment, the circuit board further includes a circuit connected between the first fixing end and the second fixing end, and the first fixing end and the second fixing end are at the same potential.

In accordance with another aspect of the present disclosure, there is provided a socket structure including a circuit board, an insulating base, a pin and a conductive component. The insulating base is disposed on the circuit board and includes a first side and a second side opposite to each other. The conductive component is connected between the circuit board and the insulating base and includes a first arm, a second arm and a connecting part. The first arm and the second arm are connected to each other through the connecting part. The first arm is fixed on the second side of the insulating base and includes a first fixing end connected to the circuit board. The pin is disposed between the first side and the second side. An end of the pin is connected between the first fixing end and the connecting part.

In an embodiment, the first fixing end passes through the circuit board.

In an embodiment, the socket structure includes a first direction, which is a direction from the first side to the second side.

In an embodiment, the socket structure is configured to be detachably connected with a plug. The plug passes through the first side along the first direction and is electrically connected to the pin.

In an embodiment, the second arm includes a second fixing end passing through the circuit board. The first fixing end and the second fixing end are spaced apart from each other and disposed on the circuit board along the first direction.

In an embodiment, the first fixing end and the second fixing end have a separation distance ranged from 3 mm to 50 mm along the first direction. The first fixing end and the second fixing end are connected to the circuit board through two individual welding joints, respectively.

In an embodiment, the first fixing end and the second fixing end are misaligned to each other along the first direction.

In an embodiment, the second arm includes a wavy portion disposed between the connecting part and the second fixing end.

In an embodiment, the second arm includes a bended portion. The bended portion and the end of the pin are misaligned to each other along the first direction, so as to facilitate the first arm being connected to the pin.

In an embodiment, the first arm, the second arm and the connecting part collaboratively form an U-shaped structure.

In an embodiment, the first arm includes a convex portion connected to the end of the pin, so as to facilitate the first arm being connected to the end of the pin.

In an embodiment, the insulating base further includes an accommodating groove adjacent to the end of the pin. The first arm of the conductive component is embedded in the accommodating groove and connected to the end of the pin, so as to reduce volume of the insulating base.

In an embodiment, the insulating base further includes a positioning column disposed on a third side and passing through the circuit board, so as to facilitate the conductive component being welded to the circuit board. The third side is connected between the first side and the second side.

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
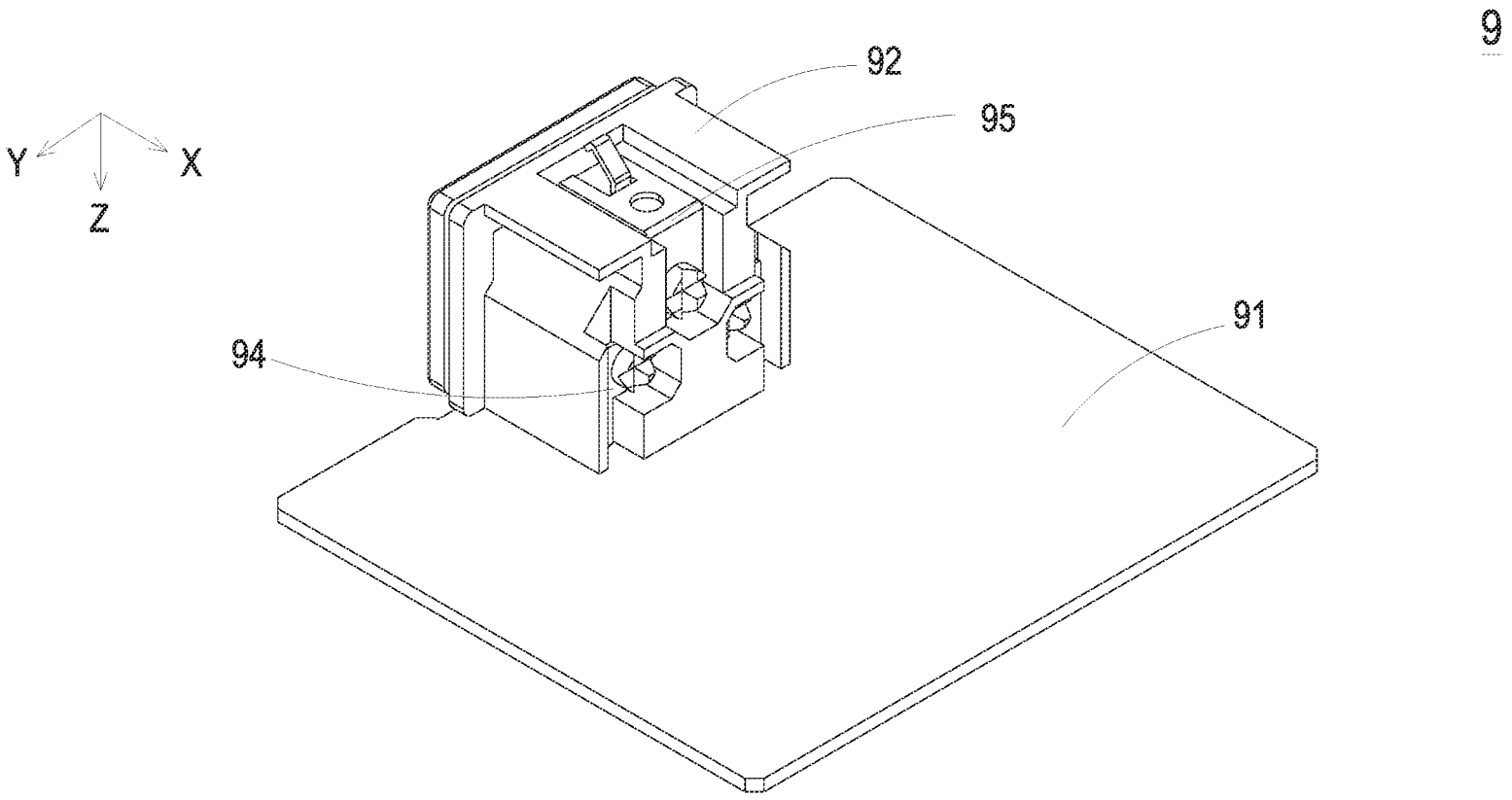
FIG. 1 PRIOR ART
FIG. 1 is a schematic perspective view illustrating a conventional socket structure.
Figure 2:
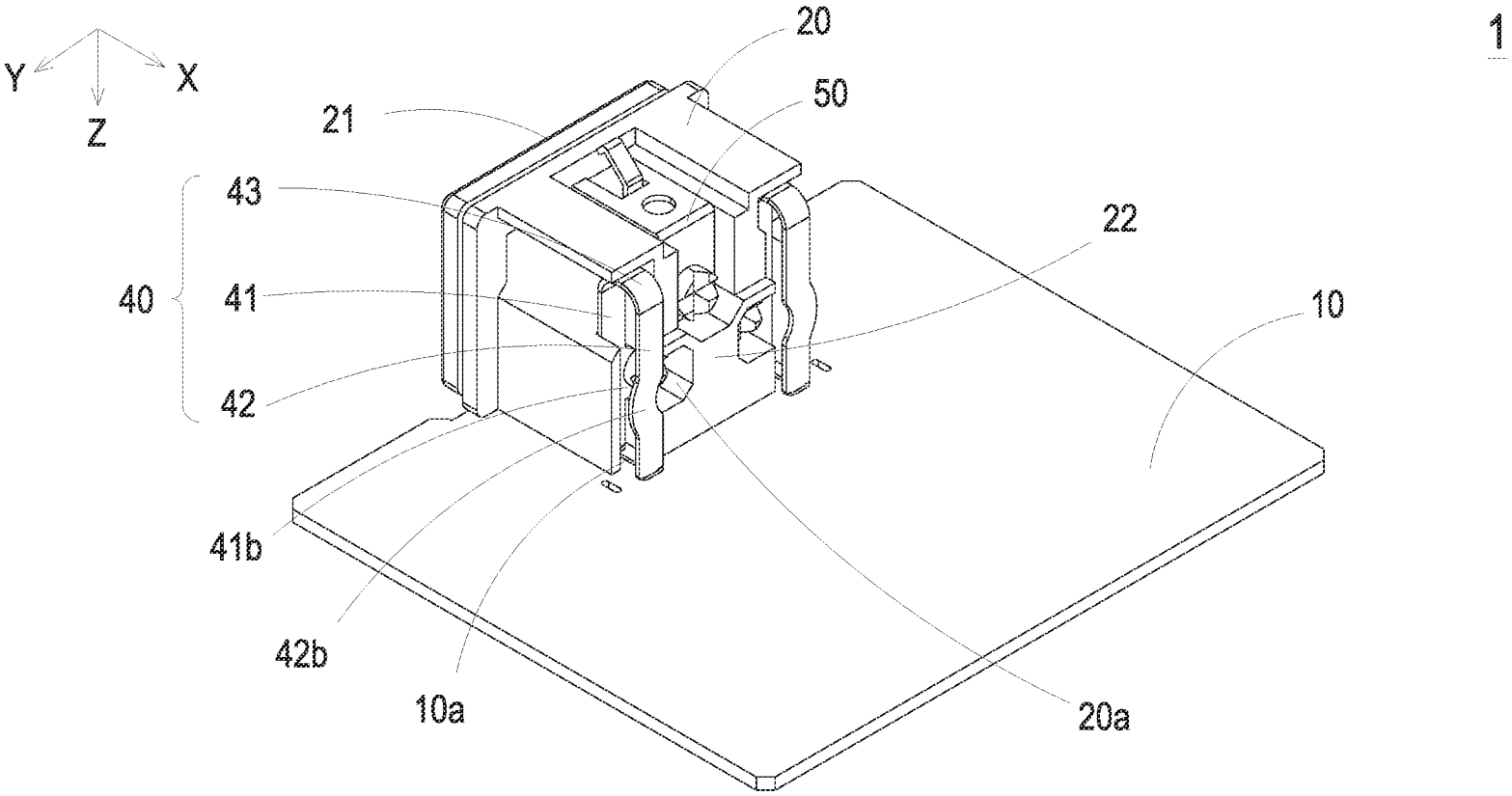
FIG. 2 is a schematic perspective view illustrating a socket structure according to a first embodiment of the present disclosure.
Figure 3:
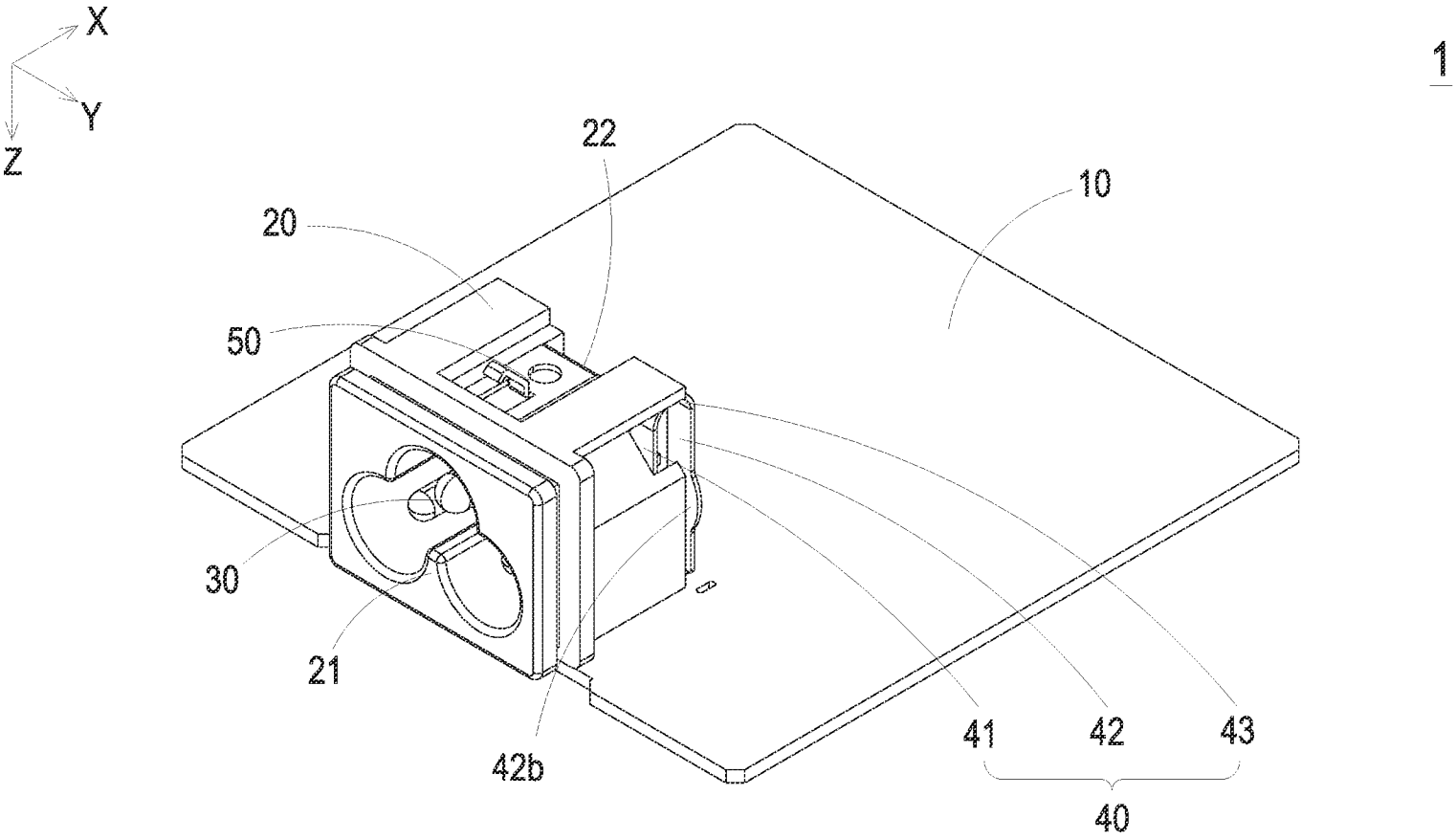
FIG. 3 is a schematic perspective view illustrating the socket structure according to the first embodiment of the present disclosure and taken from another perspective.
Figure 4:
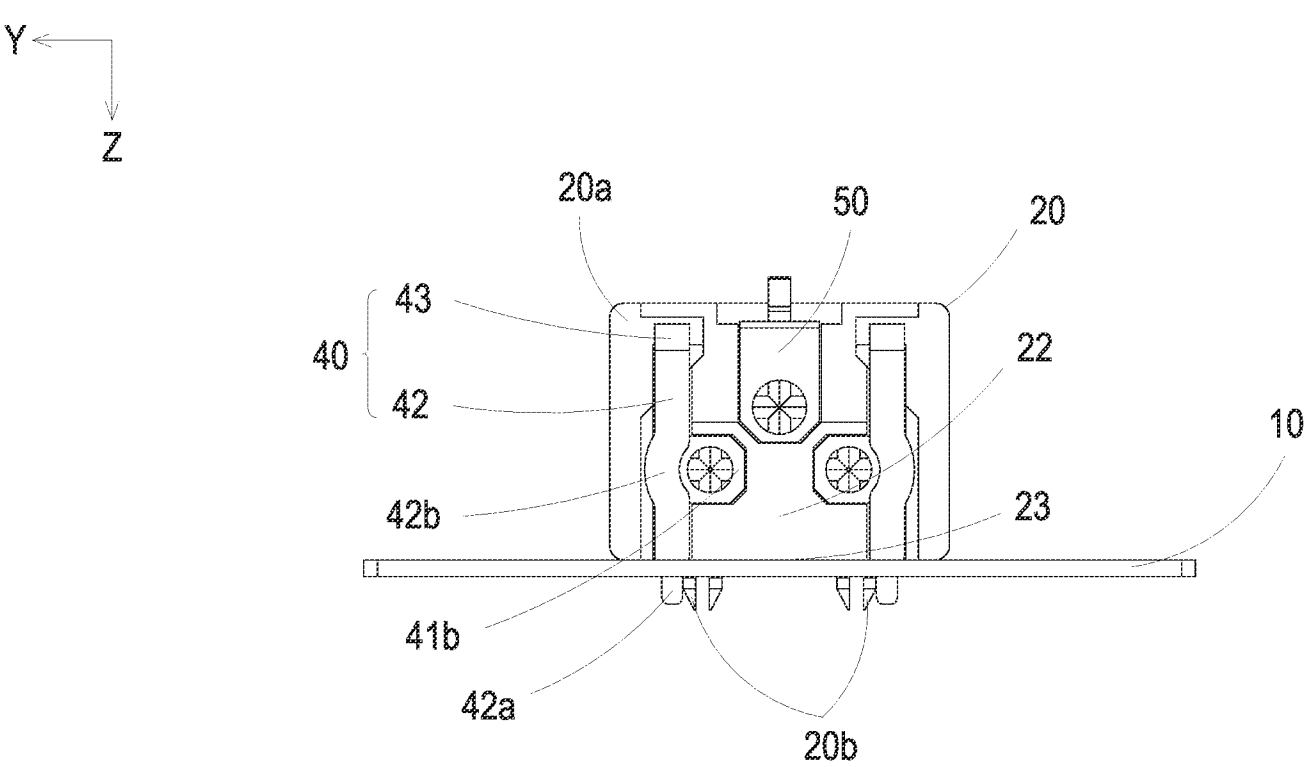
FIG. 4 is a side view illustrating the socket structure according to the first embodiment of the present disclosure.
Figure 5:
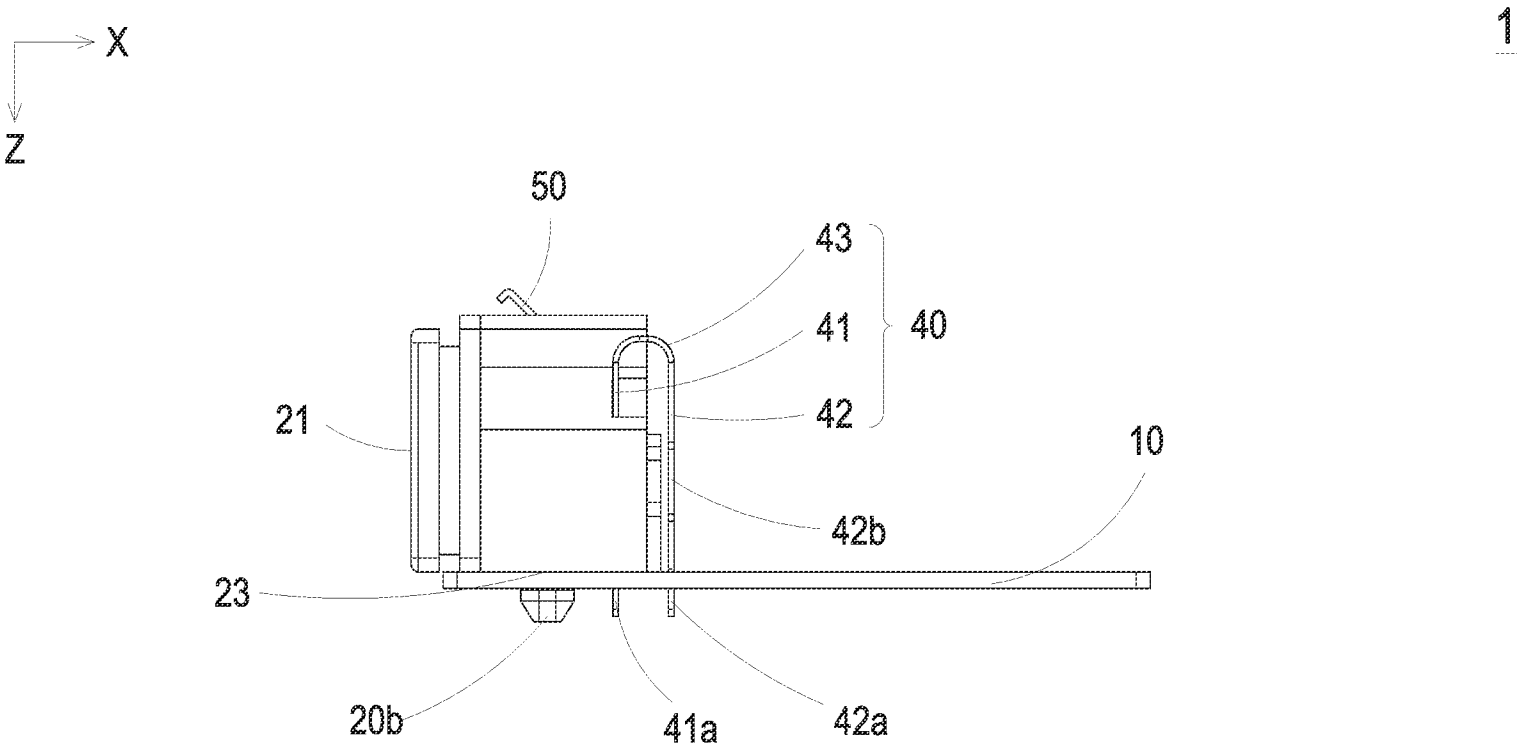
FIG. 5 is a side view illustrating the socket structure according to the first embodiment of the present disclosure and taken from another perspective.
Figure 6:
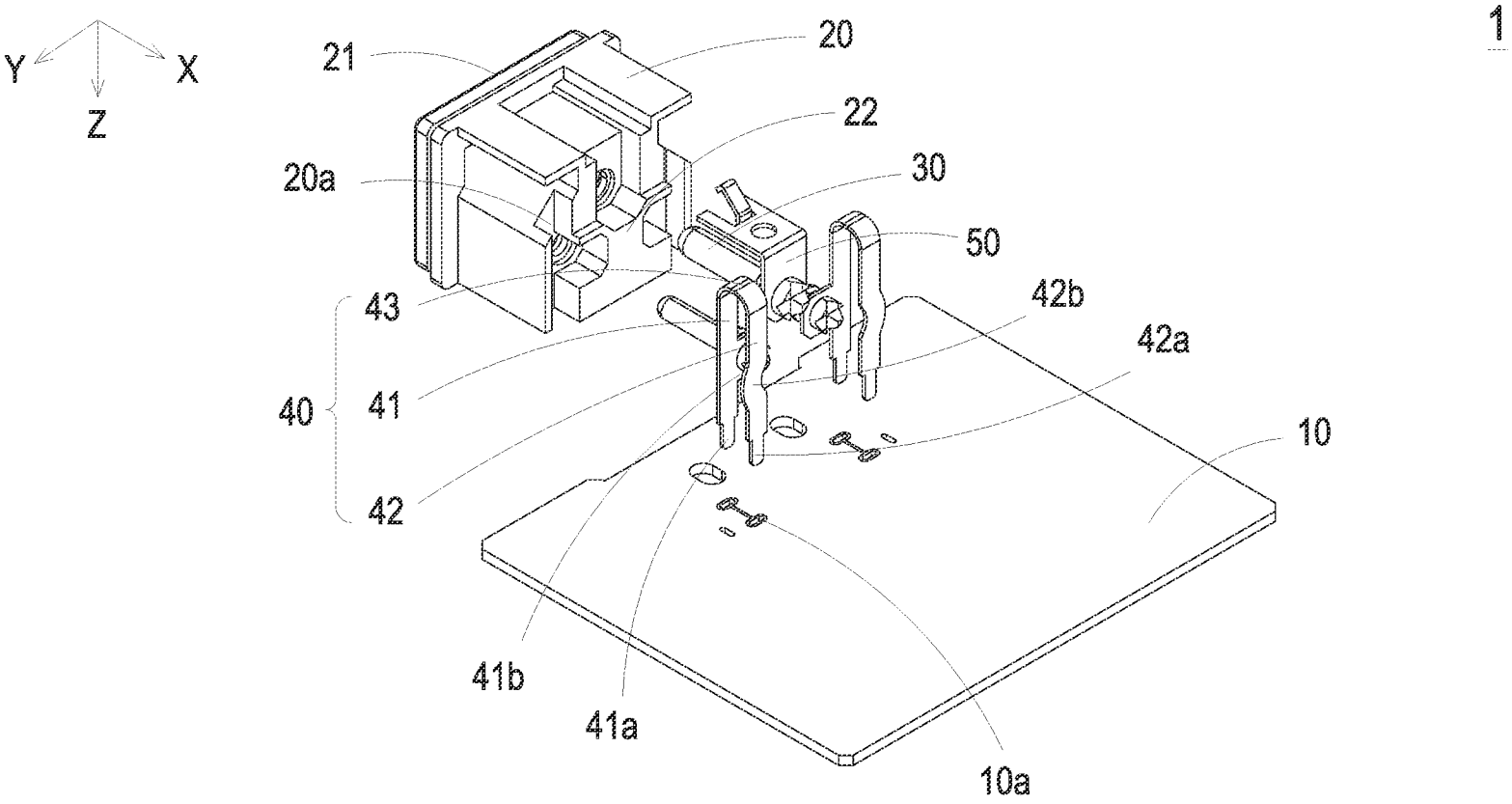
FIG. 6 is an exploded view illustrating the socket structure according to the first embodiment of the present disclosure.
Figure 7:
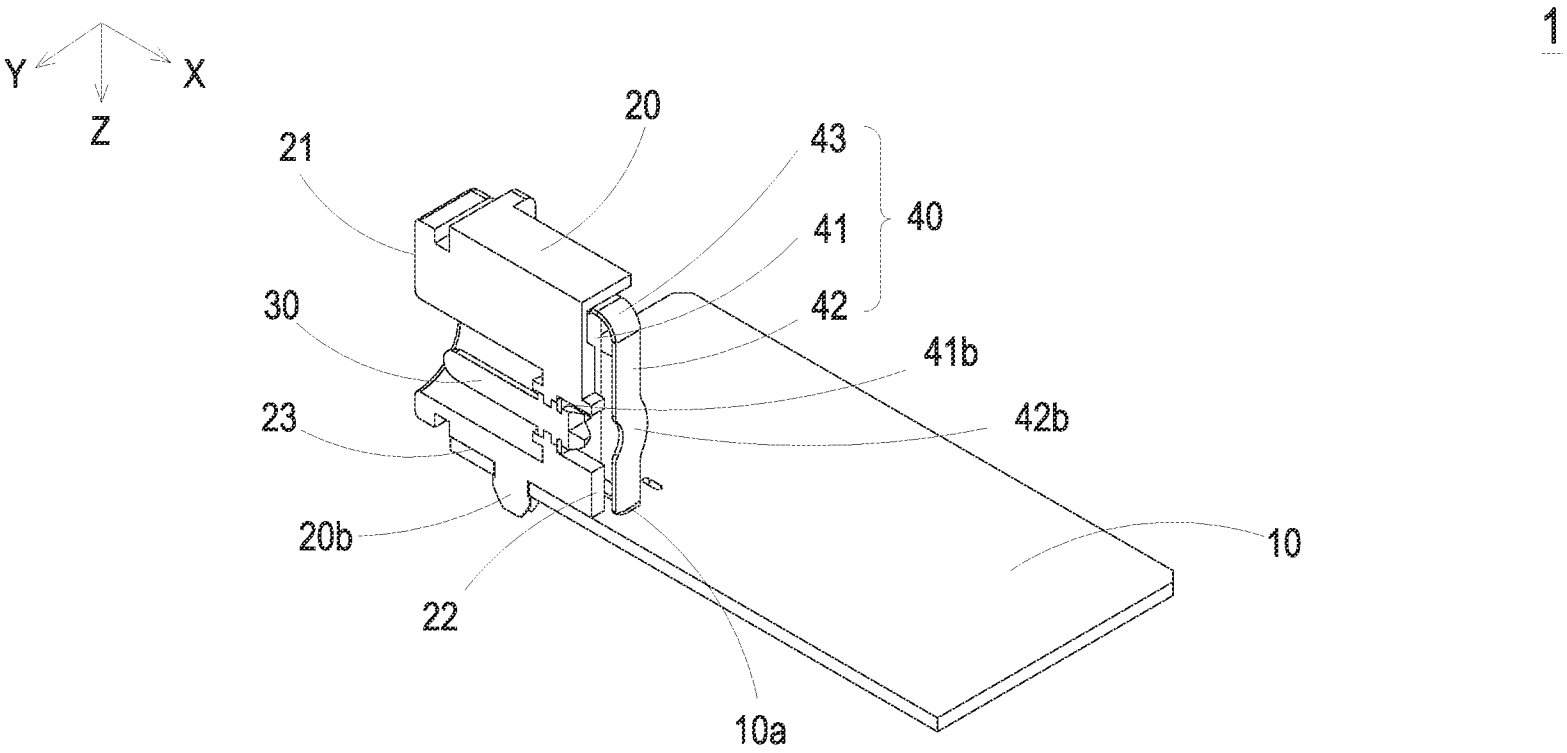
FIG. 7 is a cross-sectional view illustrating the socket structure according to the first embodiment of the present disclosure.

FIG. 2 is a schematic perspective view illustrating a socket structure according to a first embodiment of the present disclosure. FIG. 3 is a schematic perspective view illustrating the socket structure according to the first embodiment of the present disclosure and taken from another perspective. FIG. 4 is a side view illustrating the socket structure according to the first embodiment of the present disclosure. FIG. 5 is a side view illustrating the socket structure according to the first embodiment of the present disclosure and taken from another perspective. FIG. 6 is an exploded view illustrating the socket structure according to the first embodiment of the present disclosure. FIG. 7 is a cross-sectional view illustrating the socket structure according to the first embodiment of the present disclosure. In the embodiment, the socket structure 1 includes a circuit board 10, an insulating base 20, a pin 30 and a conductive component 40. The insulating base 20 is disposed on the circuit board 10 and includes a first side 21 and a second side 22 opposite to each other. The pin 30 is disposed between the first side 21 and the second side 22. Preferably but not exclusively, the pin 30 is partially accommodated within the insulating base 20. The conductive component 40 is connected between the circuit board 10 and the insulating base 20 and includes a first arm 41, a second arm 42 and a connecting part 43. The first arm 41 and the second arm 42 are connected to each other through the connecting part 43. The first arm 41 is fixed on the second side 22 of the insulating base 20, connected to the pin 30 and includes a first fixing end 41*a* connected to the circuit board 10. The second arm 42 includes a second fixing end 42*a* connected to the circuit board 10. The first fixing end 41*a* and the second fixing end 42*a* pass through the circuit board 10, respectively. In the embodiment, the pin 30 of the socket structure 1 is configured to be detachably connected with a corresponding plug (not shown), so as to achieve electrical connection. When plugging and unplugging the corresponding plug to the socket structure 1 frequently, a stress is applied to for example but not limited to a connection between the conductive component 40 and the circuit board 10. With a design of the conductive component 40 of the present disclosure, the stress applied to the conductive component 40 of the socket structure 1 is eliminated, and the stability of the electrical connection is ensured. Preferably but not exclusively, the conductive component 40 is made of an elastic metal. The conductive component 40 fixed on the circuit board 10 includes the first arm 41 and the second arm 42 connected to each other through the connecting part 43. Therefore, when plugging and unplugging the corresponding plug to the socket structure 1 frequently, the stress applied to the conductive component 40 is eliminated by deformation of the first arm 41, the second arm 42 and the connecting part 43. It is helpful for eliminating the internal stress applied to a connection such as a welding join between the conductive component 40 and the circuit board 10, so as to avoid the risk of failure due to long-term and frequent plugging and unplugging. Moreover, the entire structure is enhanced, and the stability of electrical connection is ensured.

In the embodiment, the socket structure 1 includes a first direction, such as X-axis. The first direction is a direction from the first side 21 to the second side 22. In the embodiment, the pin 30 is a male plug disposed along the first direction and configured to be detachably connected to the first arm 41 of the conductive component 40. The plug passes through the first side 21 along the first direction (X-axis) and is electrically connected to the pin 30. Preferably but not exclusively, in other embodiments, the pin 30 is a female plug. The present disclosure is not limited thereto. When plugging and unplugging the corresponding plug to the socket structure 1 frequently, a force is applied to the conductive component 40 along the first direction (X-axis). In the embodiment, the first fixing end 41*a* and the second fixing end 42*a* of the conductive component 40 are spaced apart from each other and disposed on the circuit board 10 along the first direction (X-axis). The first fixing end 41*a* and the second fixing end 42*a* pass through the circuit board 10, respectively. The first fixing end 41*a* and the second fixing end 42*a* have a separation distance ranged from 3 mm to 50 mm along the first direction, so as to facilitate the first fixing end 41*a* and the second fixing end 42*a* being connected to the circuit board 10 through two individual welding joints, respectively. Therefore, an extra supporting point is provided for enhancing the socket structure 1, so as to resist the stress caused by plugging and unplugging frequently. Preferably but not exclusively, the first arm 41, the second arm 42 and the connecting part 43 collaboratively form an U-shaped structure, and the entire structure is further enhanced. In addition, risks of damaging the internal components, reducing lifespan and causing a fire are reduced. Thus, the purposes of improving the stability and the reliability of the socket structure 1 are achieved.

In the embodiment, the first am 41 includes a convex portion 41*b* connected to an end of the pin 30. A connection between the convex portion 41*b* and the pin 30 and a bended portion 42*b* of the second arm 42 are misaligned to each other along the first direction (X-axis), so as to facilitate the first arm 41 being connected to the pin 30. Preferably but not exclusively, the first arm 41 and the pin 30 are connected by riveting. The insulating base 20 includes an accommodating groove 20*a* adjacent to the end of the pin 30. The first arm 41 of the conductive component 40 is embedded in the accommodating groove 20*a* and connected to the end of the pin 30, so as to reduce the volume of the insulating base 20 and stabilize the conductive component 40. In the embodiment, the insulating base 20 further includes two positioning columns 20*b* disposed on a third side 23 and passing through the circuit board 10. The third side 23 is connected between the first side 21 and the second side 22. Preferably but not exclusively, the two positioning columns 20*b* are buckles. In the embodiment, the two positioning columns 20*b* passes through corresponding holes of the circuit board 10 along a second direction such as Z-axis. Therefore, a positioning function is provided for facilitating the conductive component 40 being welded to the circuit board 10 accurately during installation. In the embodiment, the circuit board 10 includes a circuit 10*a* connected between the first fixing end 41*a* and the second fixing end 42*a*, and the first arm 41 and the second arm 42 are at the same potential. Therefore, when the welding point of one of the two arms fails, the normal function of the conductive component 40 is maintained by the other one of the two arms. The problem of increasing the resistance and the temperature due to the separated or cracked welding joint is avoided. In addition, the risks of damaging the internal components, reducing lifespan and causing a fire are reduced. Consequently, the purposes of improving the stability and the reliability of the socket structure 1 are achieved.

Preferably but not exclusively, in an embodiment, the socket structure 1 includes three pins 30 and two conductive components 40. The two conductive components 40 are symmetrically disposed along a third direction, such as Y-axis. In the embodiment, the two conductive components 40 are connected to the ends of the two pins 30, respectively. Preferably but not exclusively, the two conductive components 40 correspond to live wire and neutral wire of the power system, respectively. In the embodiment, the socket structure 1 includes an auxiliary conductive component 50 disposed between the two conductive components 40 and connected to an end of another pin 30. The auxiliary conductive component 50 corresponds to earth wire of the power system. The connection type of present disclosure is not limited thereto. In other embodiments, the auxiliary conductive component 50 includes a similar structure to the conductive components 40 and is electrically connected to the circuit board 10. Therefore, the entire structure is enhanced, and the stability of the electrical connection is ensured. However, it is not an essential feature to limit the present disclosure, and not redundantly described herein.

Figure 8:
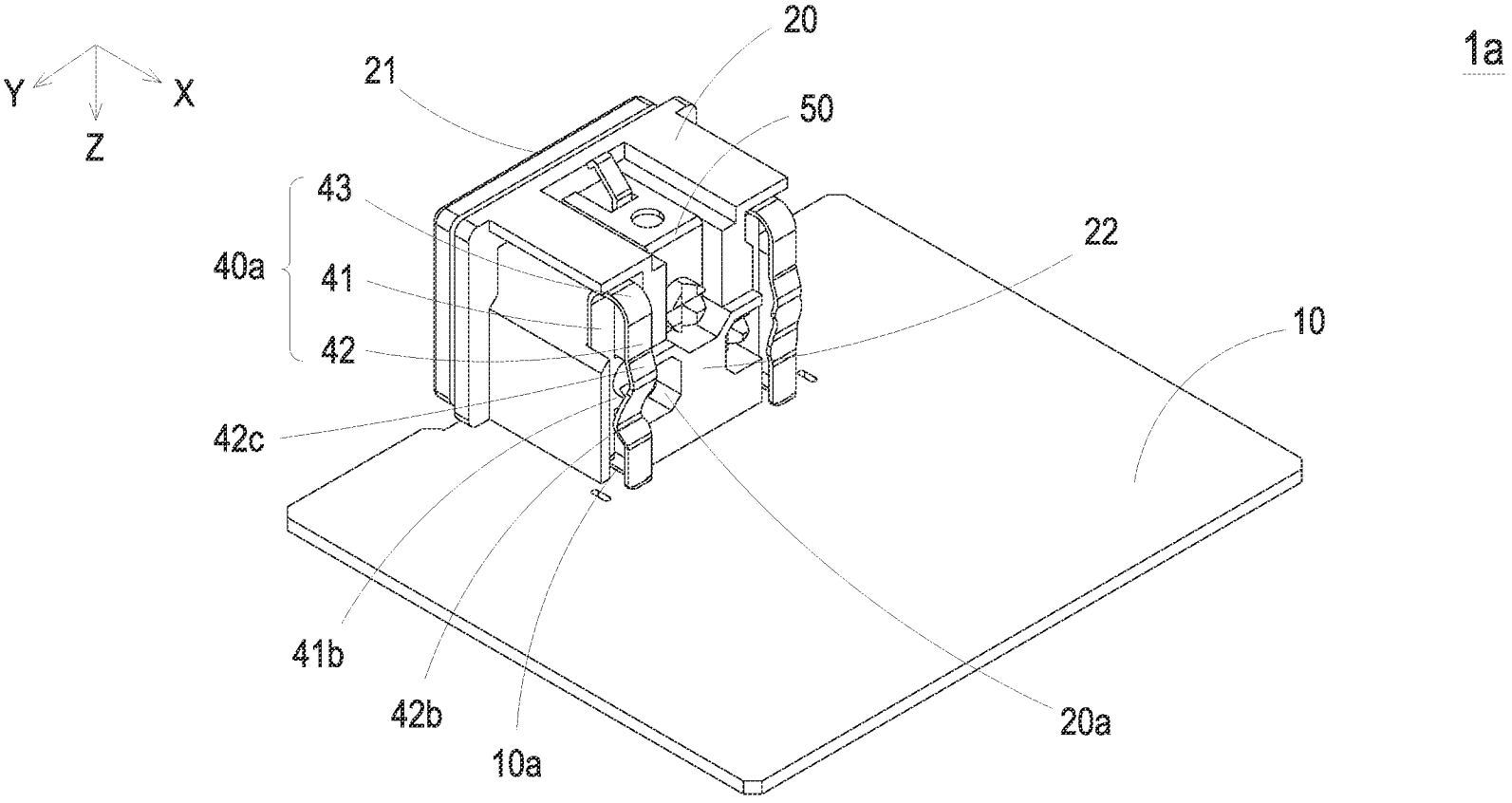
FIG. 8 is a schematic perspective view illustrating a socket structure according to a second embodiment of the present disclosure.
Figure 9:
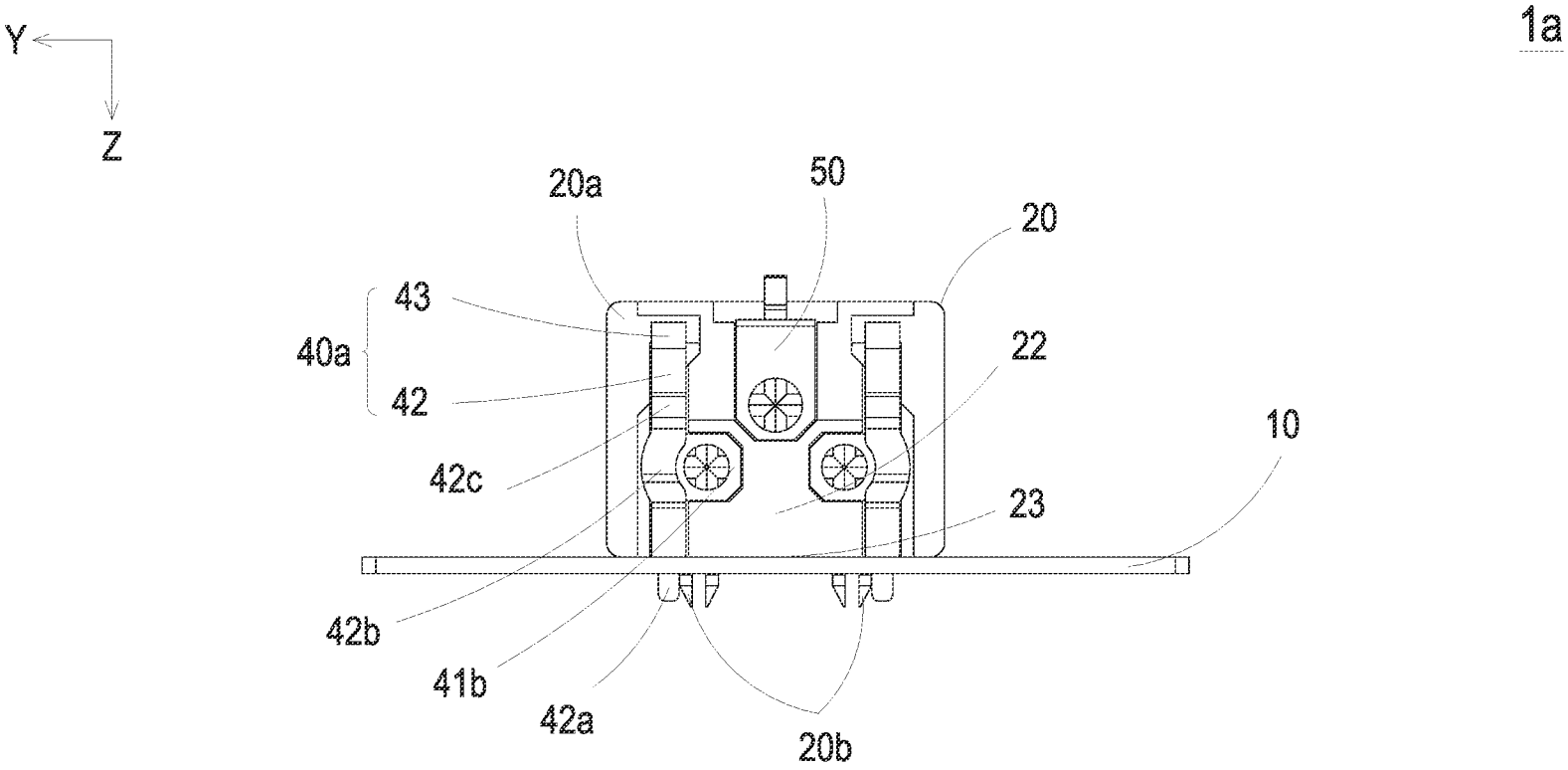
FIG. 9 is a side view illustrating the socket structure according to the second embodiment of the present disclosure.
Figure 10:
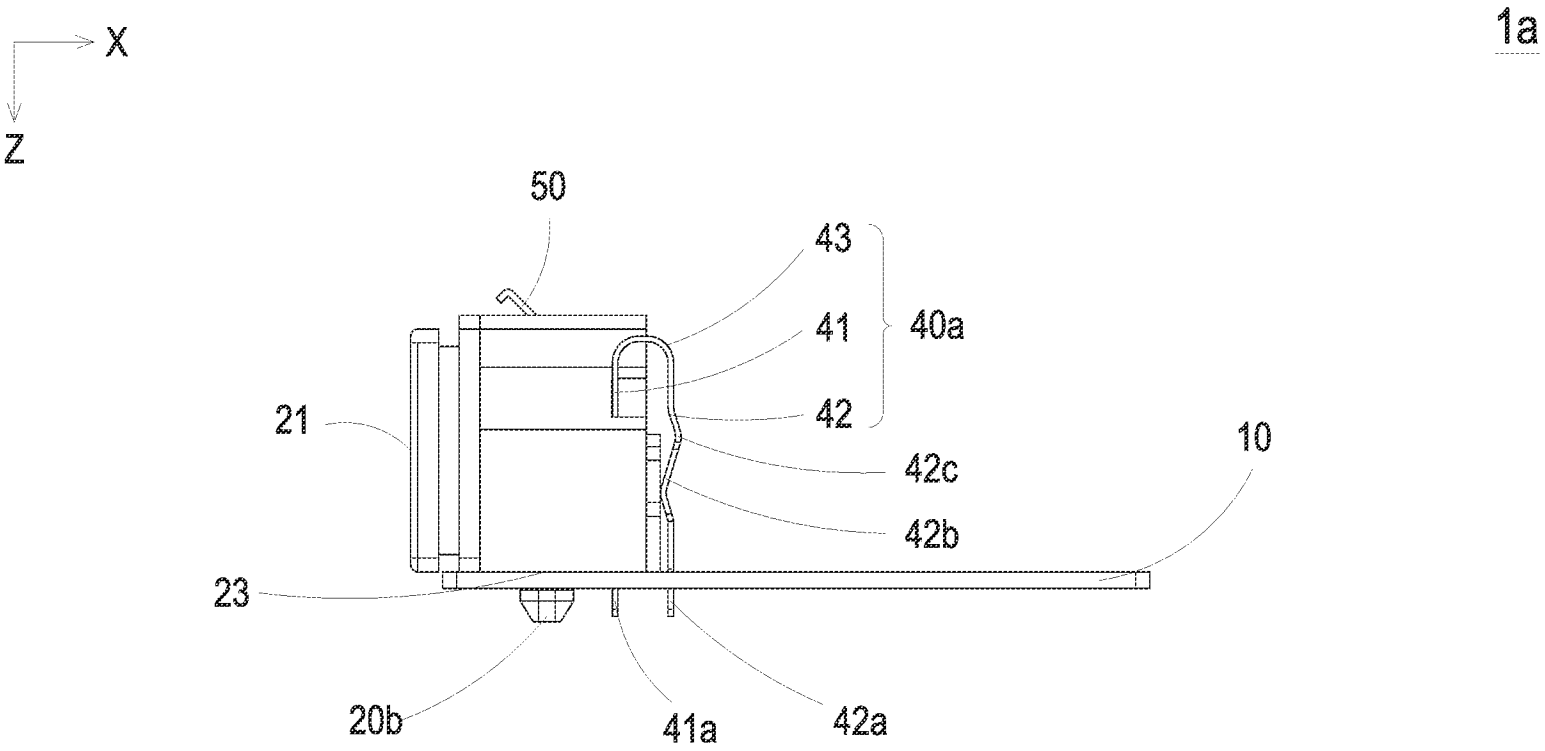
FIG. 10 is a side view illustrating the socket structure according to the second embodiment of the present disclosure and taken from another perspective.
Figure 11:
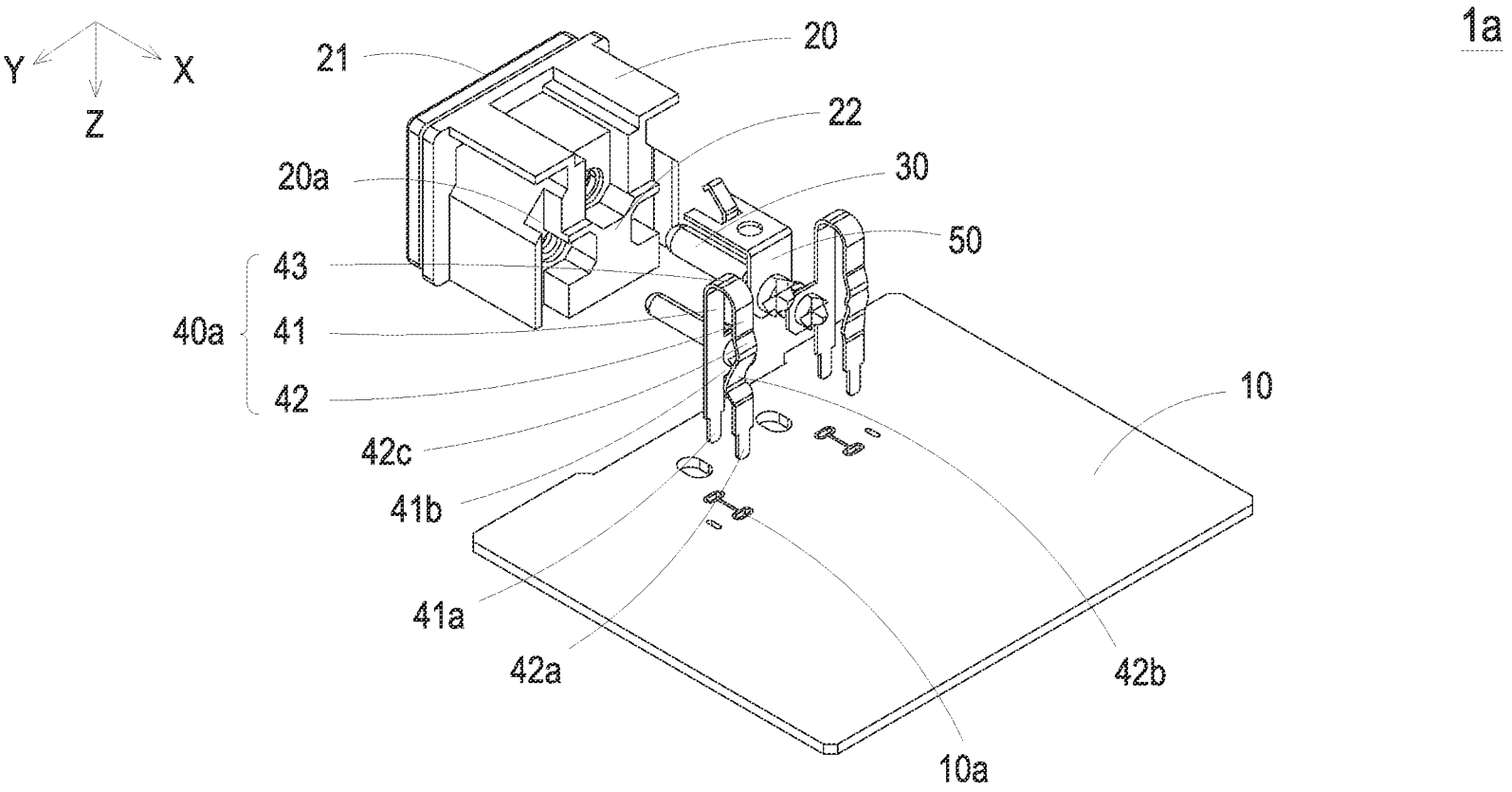
FIG. 11 is an exploded view illustrating the socket structure according to the second embodiment of the present disclosure.

FIG. 8 is a schematic perspective view illustrating a socket structure according to a second embodiment of the present disclosure. FIG. 9 is a side view illustrating the socket structure according to the second embodiment of the present disclosure. FIG. 10 is a side view illustrating the socket structure according to the second embodiment of the present disclosure and taken from another perspective. FIG. 11 is an exploded view illustrating the socket structure according to the second embodiment of the present disclosure. In the embodiment, the socket structure 1*a* is similar to the socket structure 1 shown in FIGS. 2 to 7. Component parts and elements corresponding to those of the above embodiment are designated by identical numeral references, and detailed descriptions thereof are omitted. In the embodiment, the socket structure 1*a* includes a circuit board 10, an insulating base 20, a pin 30 and a conductive component 40*a*. The insulating base 20 is disposed on the circuit board 10 and includes a first side 21 and a second side 22 opposite to each other. The pin 30 is disposed between the first side 21 and the second side 22. The conductive component 40*a* is connected between the circuit board 10 and the insulating base 20 and includes a first arm 41, a second arm 42 and a connecting part 43. The first arm 41 and the second arm 42 are connected to each other through the connecting part 43. The first arm 41 is fixed on the second side 22 of the insulating base 20, connected to the pin 30 and includes a first fixing end 41*a* passing through the circuit board 10. The second arm 42 includes a second fixing end 42*a* passing through the circuit board 10. In the embodiment, preferably but not exclusively, the first fixing end 41*a* and the second fixing end 42*a* of the conductive component 40*a* are spaced apart from each other and disposed on the circuit board 10 along a first direction (X-axis). In the embodiment, the first fixing end 41*a* and the second fixing end 42*a* of the conductive component 40*a* are connected to the circuit board 10 through two individual welding joints, respectively. In the embodiment, there is a separation distance between the first fixing end 41*a* and the second fixing end 42*a* ranged from 3 mm to 50 mm, preferably more than 3 mm. It is helpful for the first fixing end 41*a* and the second fixing end 42*a* being connected to the circuit board 10 through the two individual welding joints, respectively. Therefore, an extra supporting point is provided for enhancing the socket structure 1*a*, so as to resist the stress caused by plugging and unplugging frequently. Preferably but not exclusively, the first arm 41, the second arm 42 and the connecting part 43 collaboratively form an U-shaped structure, and the entire structure is further enhanced. Furthermore, the second arm 42 of the conductive component 40*a* includes a wavy portion 42*c*, forming the second arm 42*a* into an elastic structure similar to a spring. With the elastic structure converting force due to plugging and unplugging into deformation, the stress applied to a connection between the conductive component 40*a* and the circuit board 10 is reduced. The problem of increasing the resistance and the temperature due to the separated or cracked welding joint is avoided. In addition, the risks of damaging the internal components, reducing lifespan and causing a fire are reduced. Consequently, the purposes of improving the stability and the reliability of the socket structure 1*a* are achieved.

Figure 12:
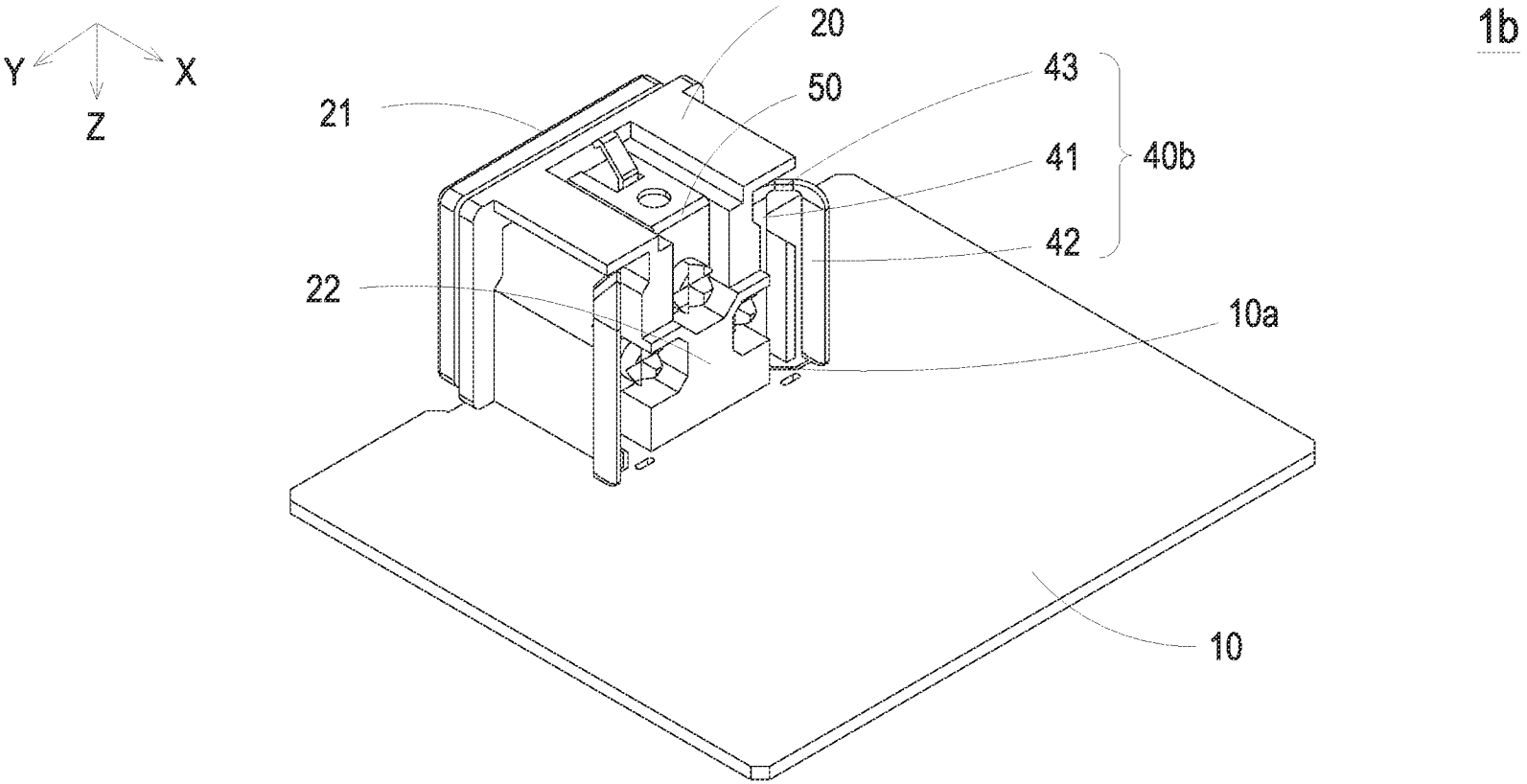
FIG. 12 is a schematic structural view illustrating a socket structure according to a third embodiment of the present disclosure.
Figure 13:
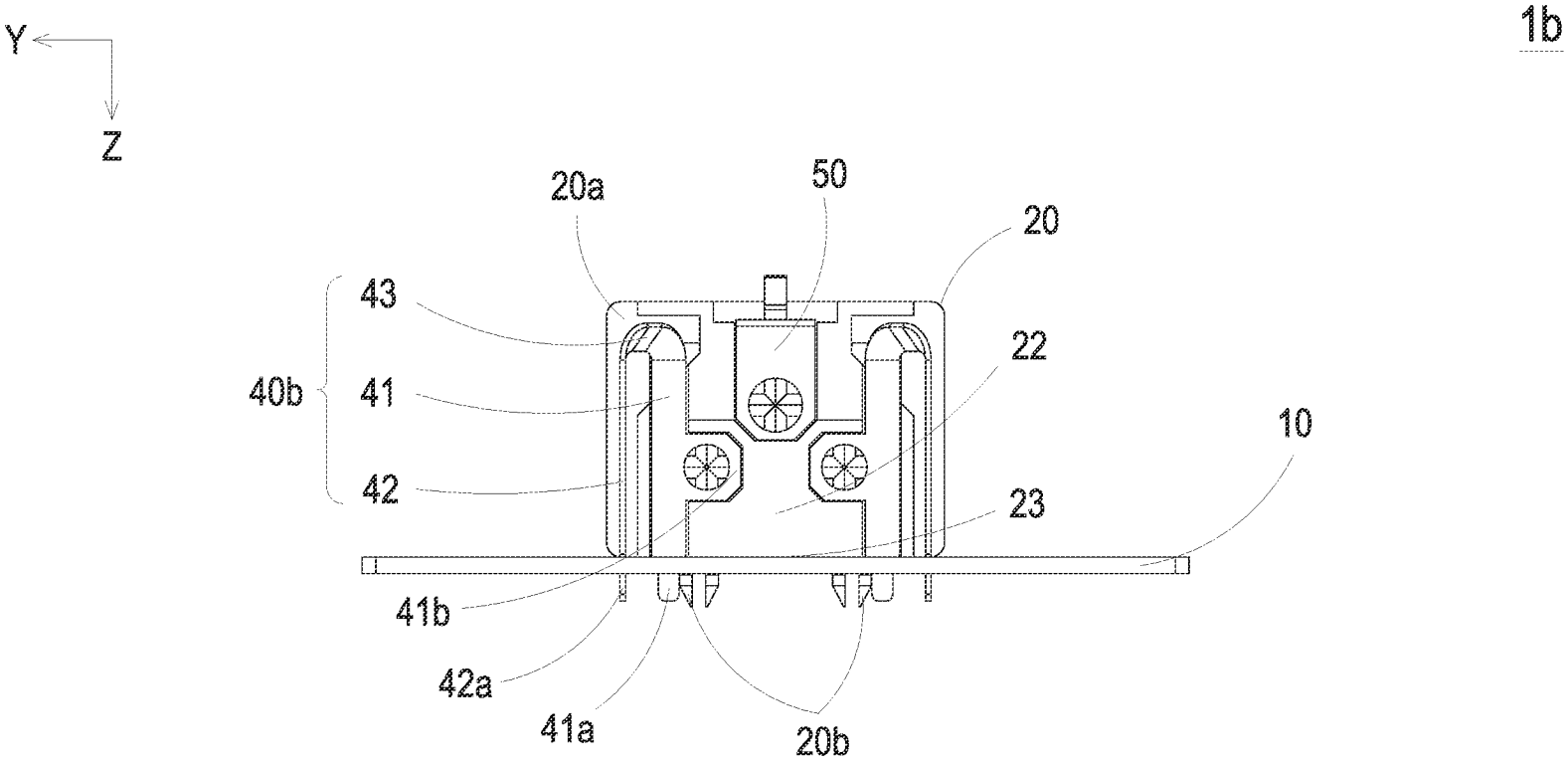
FIG. 13 is a side view illustrating the socket structure according to the third embodiment of the present disclosure.
Figure 14:
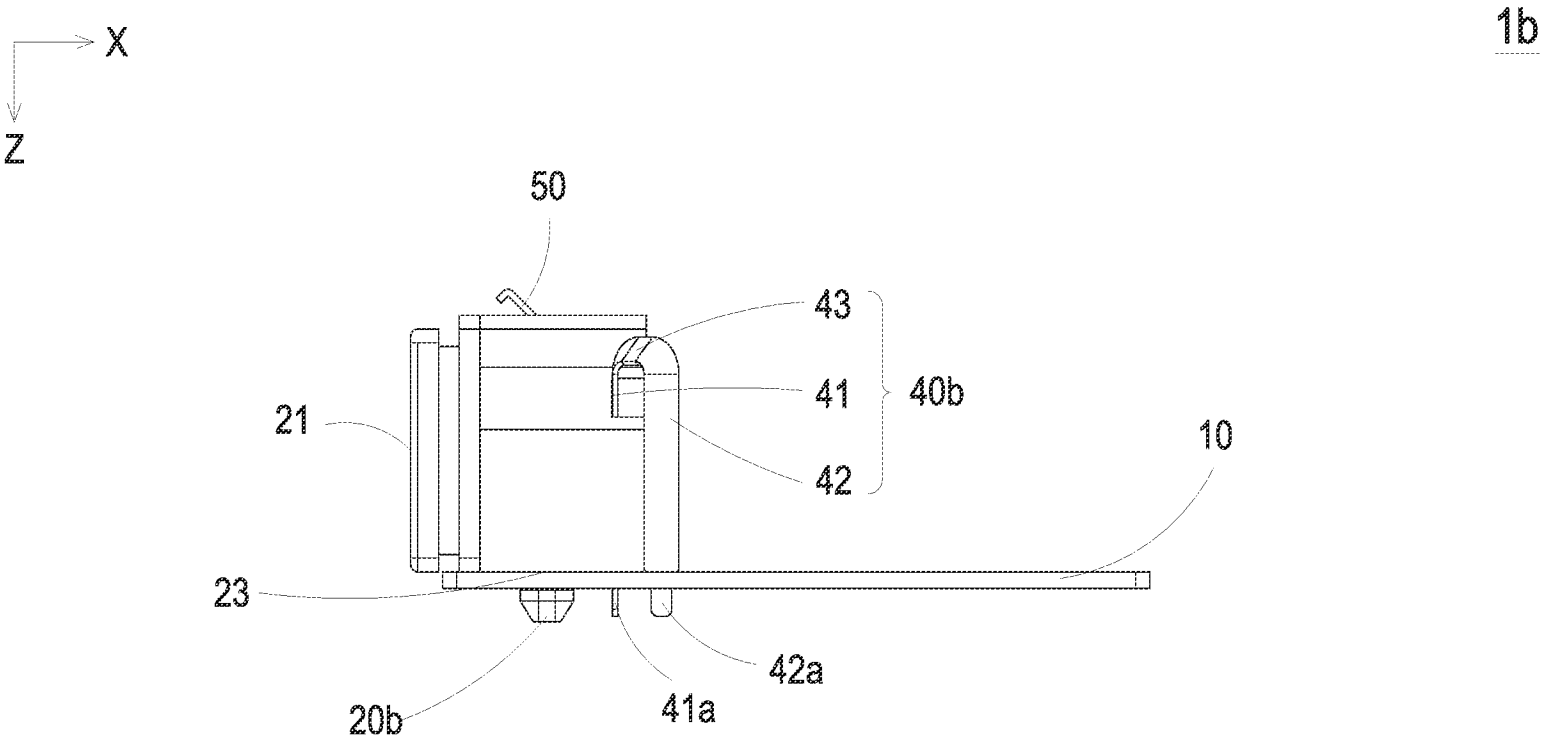
FIG. 14 is a side view illustrating the socket structure according to the third embodiment of the present disclosure and taken from another perspective.
Figure 15:
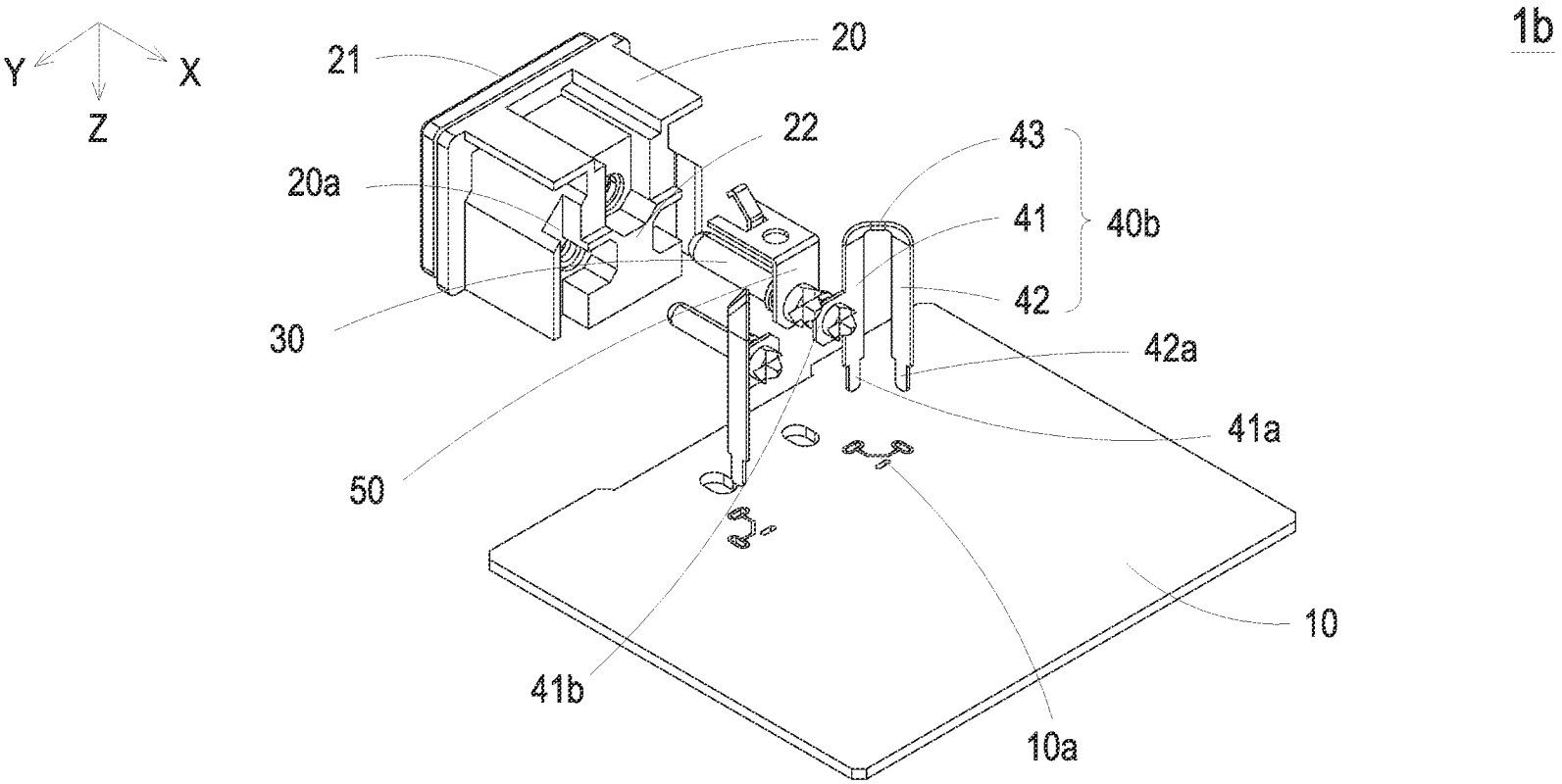
FIG. 15 is an exploded view illustrating the socket structure according to the third embodiment of the present disclosure.

FIG. 12 is a schematic perspective view illustrating a socket structure according to a third embodiment of the present disclosure. FIG. 13 is a side view illustrating the socket structure according to the third embodiment of the present disclosure. FIG. 14 is a side view illustrating the socket structure according to the third embodiment of the present disclosure and taken from another perspective. FIG. 15 is an exploded view illustrating the socket structure according to the third embodiment of the present disclosure. In the embodiment, the socket structure 1*b* is similar to the socket structure 1 shown in FIGS. 2 to 7. Component parts and elements corresponding to those of the above embodiment are designated by identical numeral references, and detailed descriptions thereof are omitted. In the embodiment, the socket structure 1*a* includes a circuit board 10, an insulating base 20, a pin 30 and a conductive component 40*b*. The insulating base 20 is disposed on the circuit board 10 and includes a first side 21 and a second side 22 opposite to each other. The pin 30 is disposed between the first side 21 and the second side 22. The conductive component 40*b* is connected between the circuit board 10 and the insulating base 20 and includes a first arm 41, a second arm 42 and a connecting part 43. The first arm 41 and the second arm 42 are connected to each other through the connecting part 43. The first arm 41 is fixed on the second side 22 of the insulating base 20, connected to the pin 30 and includes a first fixing end 41*a* passing through the circuit board 10. The second arm 42 includes a second fixing end 42*a* passing through the circuit board 10. Notably, in the embodiment, the first fixing end 41*a* and the second fixing end 42*a* are misaligned to each other along a first direction, such as X-axis. Moreover, the first fixing end 41*a* and the second fixing end 42*a* are misaligned to each other along the third direction, such as Y-axis. Thus, when the first arm 41 and the pin 30 are connected with each other by riveting, the connection between the first arm 41 and the pin 30 is not influenced by the second arm 42, and the bended portion 42*b* in the second embodiment is omitted. In other embodiments, the relative positions of the first fixing end 41*a* and the second fixing end 42*a* passing through the circuit board 10 are adjustable according to the practical requirements. For example, the positions of the first fixing end 41*a* and the second fixing end 42*a* are displaced and adjustable on the XY plane. The present disclosure is not limited thereto. In the embodiment, there is a separation distance between the first fixing end 41*a* and the second fixing end 42*a* ranged from 3 mm to 50 mm, preferably at least more than 3 mm.

It is helpful for the first fixing end 41*a* and the second fixing end 42*a* being connected to the circuit board 10 through two individual welding joints, respectively. Therefore, an extra supporting point is provided for enhancing the socket structure 1*b*, so as to resist the stress caused by plugging and unplugging frequently. Furthermore, with the misaligned first fixing end 41*a* and second fixing end 42*a*, the socket structure 1*b* is enhanced to eliminate force in different directions, such as horizontal direction or vertical direction. Therefore, when plugging and unplugging the corresponding plug to the socket structure 1*b*, the stress acting on the connection between the conductive component 40*b* and the circuit board 10 caused by shaking is reduced. The problem of increasing the resistance and the temperature due to the separated or cracked welding joint is avoided. In addition, the risks of damaging the internal components, reducing the lifespan and causing a fire are reduced. Consequently, the purposes of improving the stability and the reliability of the socket structure are achieved.

As described above, a socket structure is provided. With a design of a conductive component, stress occurred within the socket structure is eliminated, and stability of electric connection is ensured. The conductive component fixed on a circuit board further includes two arms connected by a connecting part. When plugging and unplugging a corresponding plug to the socket structure frequently, the stress acting on the conductive component is eliminated by deformation of the first arm, the second arm and the connecting part. It is helpful for eliminating the internal stress applied to a connection such as a welding joint between the conductive component and the circuit board, so as to avoid the risk of failure due to long-term and frequent plugging and unplugging. The entire structure is enhanced, and the stability of the electrical connection is ensured. A connection between a conductive component and a circuit board is further implemented by two fixing ends. When the socket structure and a corresponding plug are plugged and unplugged, an extra support point is provided by the two fixing ends. It is helpful for eliminating the internal stress applied to the welding joint connection between the conductive component and the circuit board, so as to avoid the risk of failure due to long-term and frequent plugging and unplugging. Consequently, the entire structure is enhanced, and the stability of the electrical connection is ensured. In addition to being an electrically conductive medium, the conductive component is capable of resisting the force exerted by plugging and unplugging by deformation. With an U-shaped and wavy structural design and the misaligned connecting positions of the two arms, the entire structure is further enhanced. Furthermore, the conductive component passes through and is welded to the circuit board by utilizing the two arms, and an extra supporting point is provided. Since the two arms are at the same potential, when one of the two arms fails, the normal function of the conductive component is maintained by the other one of the two arms. Therefore, with the design of the conductive component of the present disclosure, it is helpful for enhancing the socket structure. The problem of increasing the resistance and the temperature due to the separated or cracked welding joint is avoided. In addition, the risks of damaging the internal components, reducing the lifespan and causing a fire are reduced. Consequently, the purposes of improving the stability and the reliability of the socket structure are achieved.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A socket structure, comprising:

a circuit board;

an insulating base disposed on the circuit board and comprising a first side and a second side opposite to each other;

a pin disposed between the first side and the second side; and a conductive component connected between the circuit board and the insulating base, wherein the conductive component comprises a first arm, a second arm and a connecting part, and the first arm and the second arm are connected to each other through the connecting part, wherein the first arm is fixed on the second side of the insulating base, connected to the pin and comprises a first fixing end connected to the circuit board, and the second arm comprises a second fixing end connected to the circuit board.

2. The socket structure according to claim 1, wherein the first fixing end and the second fixing end pass through the circuit board, respectively, and the first fixing end and the second fixing end are connected to the circuit board through two individual welding joints, respectively.

3. The socket structure according to claim 1, wherein the socket structure further comprises a first direction, which is a direction from the first side toward the second side.

4. The socket structure according to claim 3, wherein the socket structure is configured to be detachably connected with a plug, and the plug passes through the first side of the insulation base along the first direction and is electrically connected to the pin.

5. The socket structure according to claim 3, wherein the first fixing end and the second fixing end are spaced apart from each other and disposed on the circuit board along the first direction, the first fixing end and the second fixing end are misaligned to each other along the first direction, and the first fixing end and the second fixing end have a separation distance ranged from 3 mm to 50 mm along the first direction.

6. The socket structure according to claim 3, wherein the second arm comprises a bended portion, wherein the bended portion and one end of the pin are misaligned to each other along the first direction.

7. The socket structure according to claim 1, wherein the first arm, the second arm and the connecting part collaboratively form an U-shaped structure.

8. The socket structure according to claim 1, wherein the pin is a male pin or a female pin, and the first arm is connected to an end of the pin by riveting, wherein the first arm comprises a convex portion connected to the end of the pin.

9. The socket structure according to claim 1, wherein the second arm comprises a wavy portion disposed between the connecting part and the second fixing end.

10. The socket structure according to claim 1, wherein the insulating base further comprises an accommodating groove adjacent to an end of the pin, wherein the first arm of the conductive component is embedded in the accommodating groove and connected to the end of the pin, wherein the insulating base further comprises a positioning column disposed on a third side and passing through the circuit board, wherein the third side is connected between the first side and the second side.

11. The socket structure according to claim 1, wherein the circuit board further comprises a circuit connected between the first fixing end and the second fixing end.

12. A socket structure, comprising:

a circuit board;

an insulating base disposed on the circuit board and comprising a first side and a second side opposite to each other;

a conductive component connected between the circuit board and the insulating base, wherein the conductive component comprises a first arm, a second arm and a connecting part, and the first arm and the second arm are connected to each other through the connecting part, wherein the first arm is fixed on the second side of the insulating base and comprises a first fixing end connected to the circuit board; and a pin disposed between the first side and the second side, wherein an end of the pin is connected between the first fixing end and the connecting part.

13. The socket structure according to claim 12, wherein the first fixing end passes through the circuit board, and the socket structure comprises a first direction, which is a direction from the first side to the second side.

14. The socket structure according to claim 13, wherein the socket structure is configured to be detachably connected with a plug, and the plug passes through the first side of the insulation base along the first direction and is electrically connected to the pin.

15. The socket structure according to claim 13, wherein the second arm comprises a second fixing end passing through the circuit board, the first fixing end and the second fixing end are spaced apart from each other and disposed on the circuit board along the first direction, and the first fixing end and the second fixing end are misaligned to each other along the first direction.

16. The socket structure according to claim 15, wherein the first fixing end and the second fixing end have a separation distance ranged between 3 mm and 50 mm along the first direction, wherein the first fixing end and the second fixing end are connected to the circuit board through two individual welding joints, respectively.

17. The socket structure according to claim 15, wherein the second arm comprises a wavy portion disposed between the connecting part and the second fixing end.

18. The socket structure according to claim 13, wherein the second arm comprises a bended portion, wherein the bended portion and the end of the pin are misaligned to each other along the first direction, wherein the first arm comprises a convex portion connected to the end of the pin.

19. The socket structure according to claim 18, wherein the first arm, the second arm and the connecting part collaboratively form an U-shaped structure.

20. The socket structure according to claim 18, wherein the insulating base further comprises an accommodating groove adjacent to the end of the pin, wherein the first arm of the conductive component is embedded in the accommodating groove, and the first arm is connected to the end of the pin, wherein the insulating base further comprises a positioning column disposed on a third side and passing through the circuit board, wherein the third side is connected between the first side and the second side.

* * * * *